US006041935A

United States Patent [19]

Yang

[11] Patent Number: 6,041,935

[45] Date of Patent: Mar. 28, 2000

[54] STACKABLE CASE ASSEMBLY

[76] Inventor: I-I Yang, No.2, Alley 27, Lane 81, Chang Jui Street, Taipei, Taiwan

[21] Appl. No.: 09/349,081

[22] Filed: Jul. 8, 1999

[51] Int. Cl.[7] ..... B65D 43/00

[52] U.S. Cl. ..... 206/581; 206/509; 220/4.27

[58] Field of Search ..... 206/581, 509; 220/4.26, 4.27, 23.83, 23.87, 23.88, 23.89

[56] References Cited

U.S. PATENT DOCUMENTS

| | | | |
|---|---|---|---|
| 5,246,020 | 9/1993 | Wu | 206/581 X |
| 5,507,391 | 4/1996 | Rollins | 206/509 X |
| 5,632,394 | 5/1997 | Mecca et al. | 206/581 X |

*Primary Examiner*—Jacob K. Ackun
*Attorney, Agent, or Firm*—Donald C. Casey, Esq.

[57] ABSTRACT

A stackable case assembly includes a plurality of cases. Each of the cases includes an outer case portion and an inner case portion. The outer case portion has one end face provided with a projection, with the other end face provided with a recess such that the projection can engage a recess of an adjacent case to allow stacking of a plurality of cases. The outer case further has a hollow middle portion. Positioning holes are respectively formed at upper and lower ends of the middle portion on an inner side in specific positions. The inner case portion is shaped to match the middle portion of the outer case portion, and has upper and lower ends respectively provided with a pivot in specific positions such that the inner case portion can be disposed in the middle portion of the outer case portion with the pivots engaging the positioning holes to allow the inner case portion to turn pivotally. The inner case portion can be opened or closed from one side of the outer case portion. The inner case portion further has a curved indentation at one end to facilitate to the user to exert a force to push the inner case portion away from the outer case portion, and a central portion that is recessed to form a receiving space to receive an article. The cases can be stacked to facilitate storage and display of articles without occupying much space.

1 Claim, 3 Drawing Sheets

STACKABLE CASE ASSEMBLY

BACKGROUND OF THE INVENTION (a) Field of the Invention

The present invention relates to a container, more particularly to a stackable case assembly that facilitates storage and display of articles and that does not occupy space.

(b) Description of the Prior Art

Cosmetics, such as eye shadows, lip cream, etc. are usually stored in a small container, one container for one color. If there are several colors of eye shadows of lip cream for display, several such small containers have to be used, and they will occupy space.

SUMMARY OF THE INVENTION

A primary object of the present invention is to provide a stackable case assembly that includes a plurality of cases that can be stacked in a compact manner and that is openable to display articles contained there in a three-dimensional manner. According to the present invention, the case is generally cylindrical and has a projection on one side and a recess on the other side for engaging the projection of an adjacent case. The case further has a receiving space that is openable or closable from one side.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
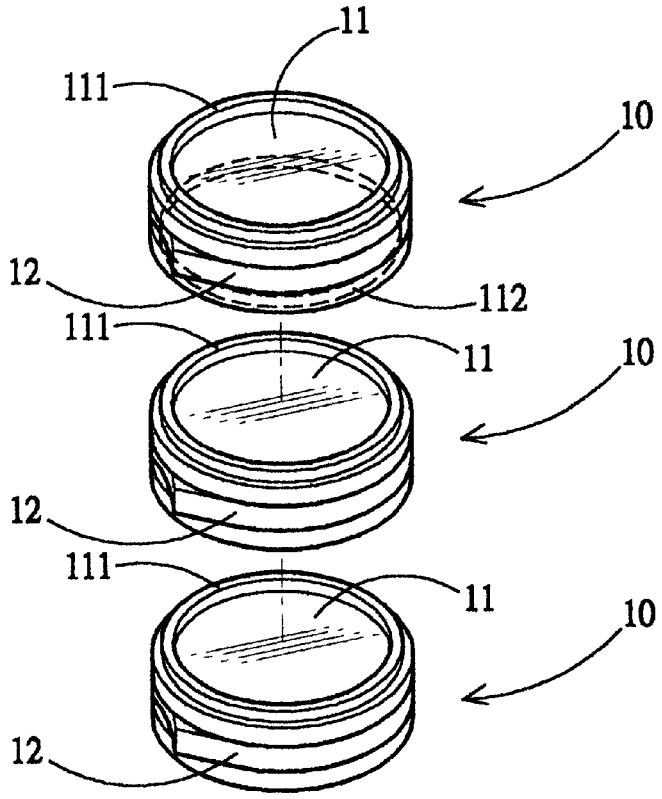
FIG. 1 is an exploded schematic view of the present invention.
Figure 2:
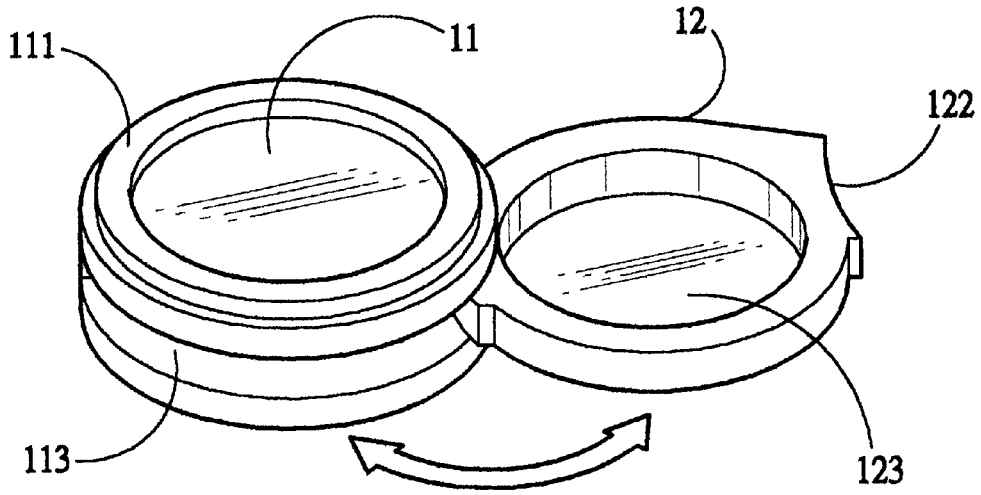
FIG. 2 is a schematic view of a case of the present invention.
Figure 3:
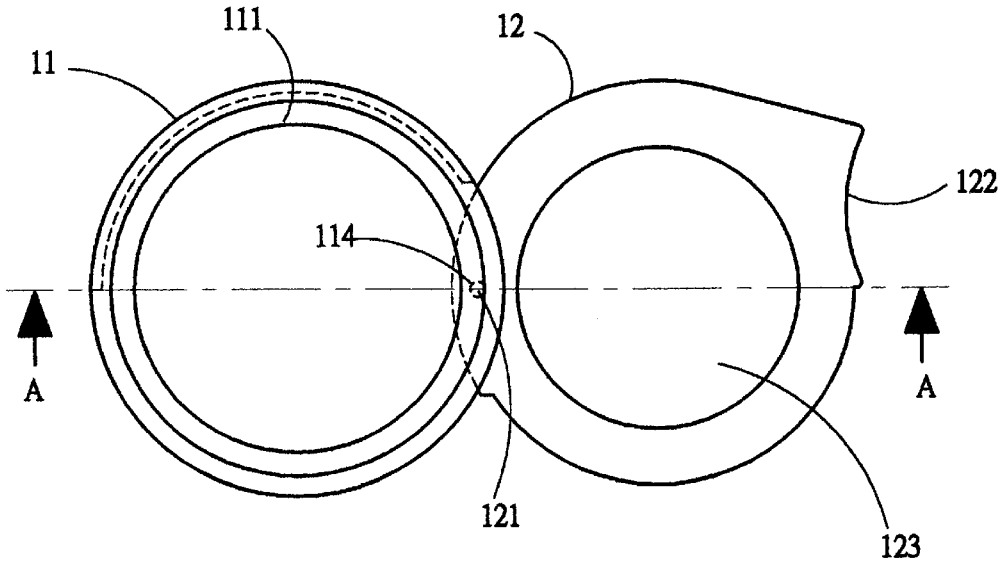
FIG. 3 is a top schematic view of the case of the present invention.
Figure 4:
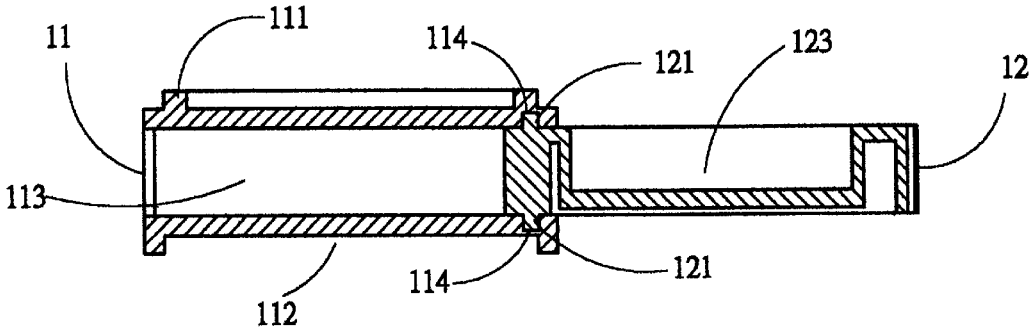
FIG. 4 is a sectional view taken along line A—A of FIG. 3.

FIG. 1 shows a plurality of cases 10 embodying the present invention arranged in a stack. Each case 10 has a generally cylindrical body, and includes an outer case portion 11 and an inner case portion 12. The outer case portion 11 has one end face provided with a projection 111 of a slightly smaller diameter than the external diameter of the case 10, and the other end face provided with a recess 112 for receiving the projecting 111 of an adjacent case 10 such that a plurality of cases 10 can be firmly positioned and stacked to save space. Referring to FIGS. 2, 3 and 4, the outer case portion 11 further has a hollow middle portion 113 between the end faces for accommodating the inner case portion 12. Two positioning holes 114 are respectively provided at upper and lower ends of an inner side of the middle portion 113 in specific positions. The inner case portion 12 has upper and lower ends respectively provided with a pivot 121 for insertion into a respective one of the positioning holes 114 such that the inner case portion 12 can turn pivotally using the pivots as a center of rotation.

Figure 5:
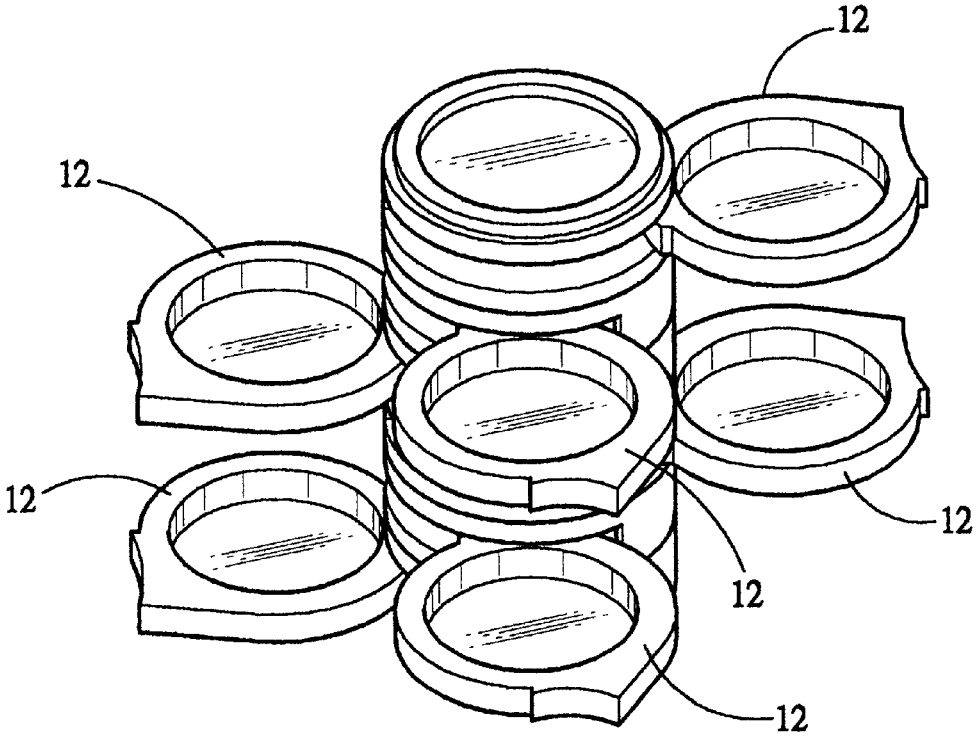
FIG. 5 is a schematic view of the present invention in use.

Referring to FIG. 2, the inner case portion 12 can be opened or closed from one side of the outer case portion 11 in a direction indicated by the arrow in FIG. 2. The inner case portion 12 is provided with a curved indentation at one end to facilitate the user to exert a force to push the inner case portion 12 away from the outer case portion 11. The inner case portion 12 has a central portion that is depressed to form a receiving space 123 adapted to receive an article. By placing the article in the receiving space 123 of the inner case portion 12, the article can be stored in the inner case portion 11. The cases 10 can be stacked easily in a very compact manner to save space and facilitate storage. Referring to FIG. 5, if the cases 10 are adapted to contain eye shadows and lip cream of different colors, the cases 10 can be stacked randomly such that the opening positions of the inner case portions 12 are located at different positions. In this way, a three-dimensional case assembly can be erected for displaying the eye shadows and lip cream. Certainly, it should be understood that the present invention can be adapted to store other articles, not confined to cosmetics, in a space-saving and compact manner.

In summary, the stackable case assembly according to the present invention includes cases, each of which has an outer case portion and an inner case portion. The outer case portion has two end faces respectively provided with a projection and a recess to allow stacking of the cases, and is openable or closable at one end to allow access to the inner case portion that stores articles. The case assembly of the present invention facilitates storage and display of articles and does not occupy space.

Although the present invention has been illustrated and described with reference to the preferred embodiment thereof, it should be understood that it is in no way limited to the details of such embodiment but is capable of numerous modifications within the scope of the appended claims.

What is claimed is:

1. A stackable case assembly comprising a plurality of eases, each of said cases comprises:

an outer case portion having one end face provided with a projection, with the other end face provided with a recess such that said projection can engage a recess of an adjacent case to allow stacking of a plurality of cases, said outer case having a hollow middle portion, positioning holes being respectively formed at upper and lower ends of said middle portion on an inner side in specific positions; and an inner case portion shaped to match said middle portion of said outer case portion, and having upper and lower ends respectively provided with a pivot in specific positions such that said inner case portion can be disposed in said middle portion of said outer case portion with said pivots engaging said positioning holes to allow said inner case portion to turn pivotally using said pivots as centers of rotation, whereby said inner case portion can be opened or closed from one side of said outer case portion, said inner case portion further having a curved indentation at one end to facilitate to the user to exert a force to push said inner case portion away from said outer case portion, and a central portion that is recessed to form a receiving space to receive an article.

* * * * *